US011950663B1

(12) United States Patent
Rowland et al.

(10) Patent No.: US 11,950,663 B1
(45) Date of Patent: Apr. 9, 2024

(54) BELT BUCKLE SYSTEM

(71) Applicant: TEAM NexBelt Operating, Inc., Rancho Cucamonga, CA (US)

(72) Inventors: Edward Rowland, Rancho Cucamonga, CA (US); Tom Hunsucker, Rancho Cucamonga, CA (US)

(73) Assignee: TEAM NexBelt Operating, Inc., Corona, CA (US)

( * ) Notice: Subject to any disclaimer, the term of this patent is extended or adjusted under 35 U.S.C. 154(b) by 0 days.

(21) Appl. No.: 17/949,740

(22) Filed: Sep. 21, 2022

Related U.S. Application Data

(60) Provisional application No. 63/247,079, filed on Sep. 22, 2021.

(51) Int. Cl.
*A44B 11/16* (2006.01)

(52) U.S. Cl.
CPC ..... *A44B 11/16* (2013.01); *A44D 2203/00* (2013.01)

(58) Field of Classification Search
CPC ..... A44B 11/16; A44B 11/12; A44B 11/006; A44B 11/24; A44D 2203/00
See application file for complete search history.

(56) References Cited

U.S. PATENT DOCUMENTS 1,483,853 A * 2/1924 Schwerd ..... A44B 11/00 24/587.12
3,466,668 A * 9/1969 Ochiai ..... A44B 11/12 2/322
5,572,747 A * 11/1996 Cheng ..... A44B 11/12 2/322
5,579,563 A * 12/1996 Sim ..... A44B 11/2592 24/615
10,548,362 B1 * 2/2020 Hunsucker ..... A44B 11/125
10,681,963 B1 * 6/2020 Rowland ..... A41F 9/002
11,540,597 B1 * 1/2023 Rowland ..... A44B 11/006
2010/0018008 A1 * 1/2010 Ahn ..... A44B 11/16 24/303
2023/0140240 A1 * 5/2023 Rowland ..... A44B 11/125 24/191

FOREIGN PATENT DOCUMENTS

EP 2258221 A1 * 12/2010 ..... A41F 9/002

* cited by examiner

*Primary Examiner* — Robert Sandy
*Assistant Examiner* — Louis A Mercado
(74) *Attorney, Agent, or Firm* — Foley & Lardner LLP

(57) ABSTRACT

A belt system including a belt having a free end, an opposed clamp end, and a plurality of teeth positioned along the free end of the belt. The buckle includes a latch that is actuatable between an engaged position and a retracted position. Wherein when the latch is in the engaged position, the latch is biased against the teeth to mechanically engage the teeth and secure the belt free end with the buckle. When the latch is in the retracted position, the latch is retracted from the teeth to permit removal of the belt free end from the buckle. The buckle also includes a clamp member to secure the belt clamp end to the buckle. The clamp member is positioned on the buckle such that the free end of the belt is substantially concealed by the clamp member and the clamp end of the belt when the free end is inserted through the buckle.

20 Claims, 7 Drawing Sheets

BELT BUCKLE SYSTEM

CROSS-REFERENCE TO RELATED PATENT APPLICATIONS

This application is a non-provisional patent application which, pursuant to 35 U.S.C. 119(e), claims priority to and the benefit of U.S. Provisional Application No. 63/247,079, filed Sep. 22, 2021, which is incorporated by reference herein in its entirety.

BACKGROUND

Conventional belt buckles or belt adjustment systems are limited in their ability to conform to a particular user's waist size. Belt adjustment systems conventionally secure a belt about a user's waist by relying on a series of spaced holes punched through an end of a belt. A hook of a belt buckle can be inserted through a hole to capture the end of the belt to secure the belt in a loop of a particular size. The spacing between each of the holes as well as the overall number of holes can vary for adjustment of belt size but is generally limited by the minimal material that must remain between the holes.

Conventional belt adjustment systems are limited to setting the size of the belt loop to discrete sizes based upon the spacing of the holes in the belt. If a user desires to set the belt to a loop size that is positioned between the holes in the belt, the user has to manually create an additional hole in the belt, which can be difficult and unattractive if not performed well. Alternately, the user must use the next smaller or next larger belt loop size relative to the desired size, which can be uncomfortable for the user.

Furthermore, once a conventional belt is fixed into position, the free end of the belt must also be secured to the exterior of the belt buckle. This is because conventional belts do not have the structural rigidity to be readily pushed through a buckle and must be pulled through a buckle. This results in the free end of the belt dangling outside of the belt buckle and having to be secured with other belt loops.

SUMMARY OF THE INVENTION

According to a first aspect, there is provided a belt system including a belt having a free end, an opposed clamp end, and a plurality of teeth positioned along the free end of the belt. The buckle includes a latch that is actuatable between an engaged position and a retracted position. Wherein when the latch is in the engaged position, the latch is biased against the teeth to mechanically engage the teeth and secure the belt free end with the buckle. When the latch is in the retracted position, the latch is retracted from the teeth to permit removal of the belt free end from the buckle. The buckle also includes a clamp member to secure the belt clamp end to the buckle. The clamp member is positioned on the buckle such that the free end of the belt is substantially concealed by the clamp member and the clamp end of the belt when the free end is inserted through the buckle.

According to other embodiments, the clamp and the buckle are separate components.

According to yet another embodiment, the belt includes a series of markings on an inner surface of the belt near the clamp end, wherein each marking corresponds to a clothing waist size.

In other embodiments, the latch is a pawl.

In some embodiments, the belt system further includes a biasing member configured to bias the latch.

In yet another embodiment, the biasing member is a magnet.

According to still another embodiment, the biasing member is a spring.

According to other embodiments, the biasing member is a first biasing member and further comprising a second biasing member configured to bias the latch.

In other embodiments, the first biasing member is a magnet and the second biasing member is a magnet.

In some embodiments, the latch is configured to be actuated from the engaged position to the free position by a release member.

According to a second aspect, there is provided a belt buckle configured to be positioned on a first end of a belt and to mechanically engage a second end of the belt to secure the belt in a looped configuration when the second end of the belt is inserted into the buckle. The buckle further includes a latch secured to the buckle and biased by a biasing member towards an engaged position to engage a series of teeth disposed on the belt when the belt second end is inserted into the buckle. The buckle is further configured such that the second end of the belt is concealed by the first end of the belt when the second end is inserted into the buckle.

According to some embodiments, the belt includes a series of markings on an inner surface of the belt near the first end, wherein each marking corresponds to a clothing waist size.

According to other embodiments, the latch is a pawl.

In yet another embodiment, the biasing member is a magnet.

In still another embodiment, the biasing member is a spring.

According to other embodiments, the biasing member is a first biasing member and further including a second biasing member configured to bias the latch.

BRIEF DESCRIPTION OF THE DRAWINGS

The disclosure will become more fully understood from the following detailed description, taken in conjunction with the accompanying figures, wherein like reference numerals refer to like elements, in which.

The drawings are not necessarily to scale and certain features may be shown exaggerated in scale or in somewhat schematic form in the interest of clarity and conciseness.

DETAILED DESCRIPTION

Embodiments disclosed herein describe a belt system 100 that may be worn with a pair of pants, shorts, trousers, skirts or other articles of clothing. The system 100 can also be used with other items such as watchstraps, purse straps, guitar straps or animal collars or other articles that may include a buckle system that is adjusted for size or where a number of size variations would be desirable.

Figure 1:
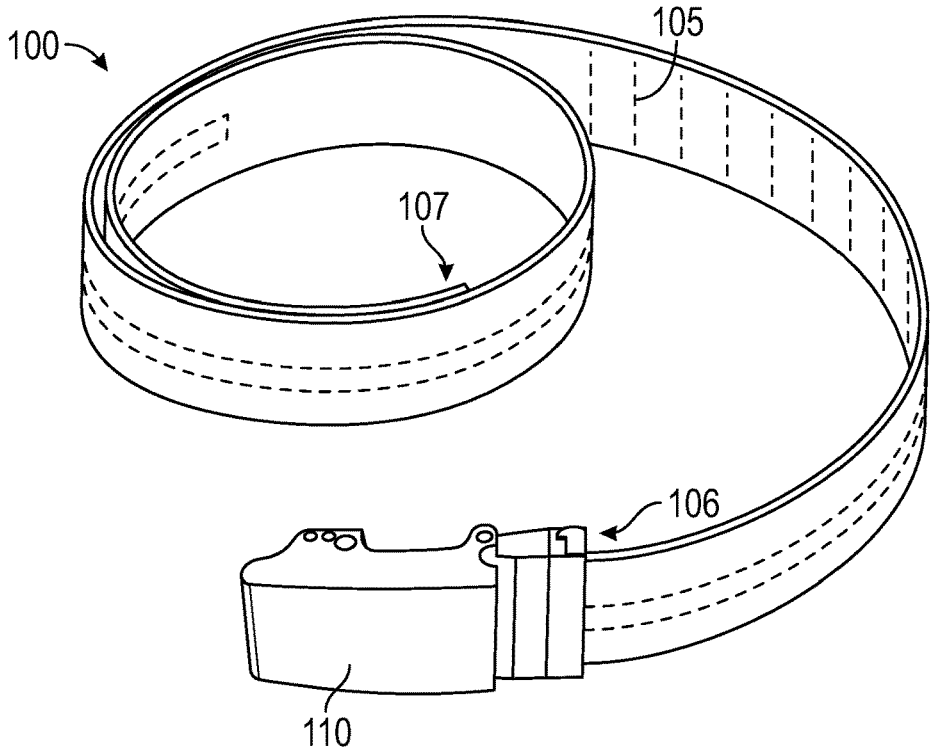
FIG. 1 is a top-side perspective view of a belt system, according to an embodiment of the present disclosure.
Figure 2:
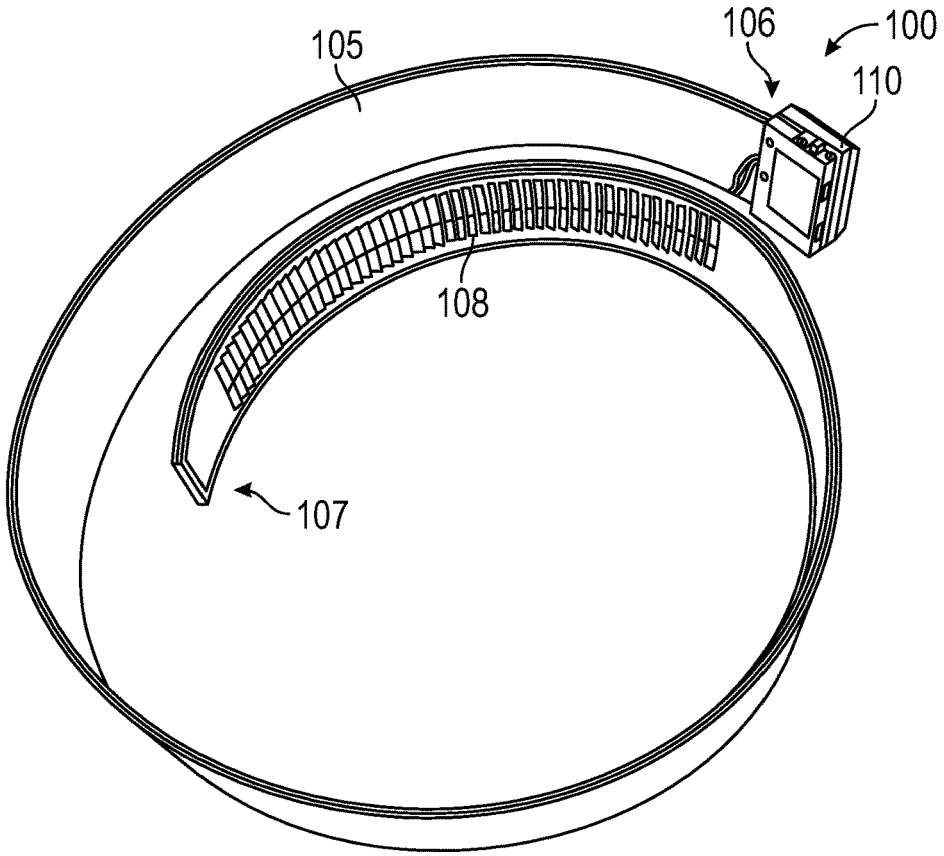
FIG. 2 is a top-side perspective view of another embodiment of a belt system, according to an embodiment of the present disclosure.

FIGS. 1 and 2 illustrate a perspective view of an embodiment of the belt system 100. In FIGS. 1 and 2, the belt system 100 includes an elongated belt 105 and a buckle 110. The belt 105 includes a clamp end 106, a free end 107 and a latching surface that includes an integrated series of teeth or other engagement members 108 to, as discussed in greater detail below, tighten the belt system 100 and maintain the belt 105 in a looped configuration. The buckle 110 is disposed on, secured to, or positioned about the clamp end 106 of the belt 105.

Figure 3:
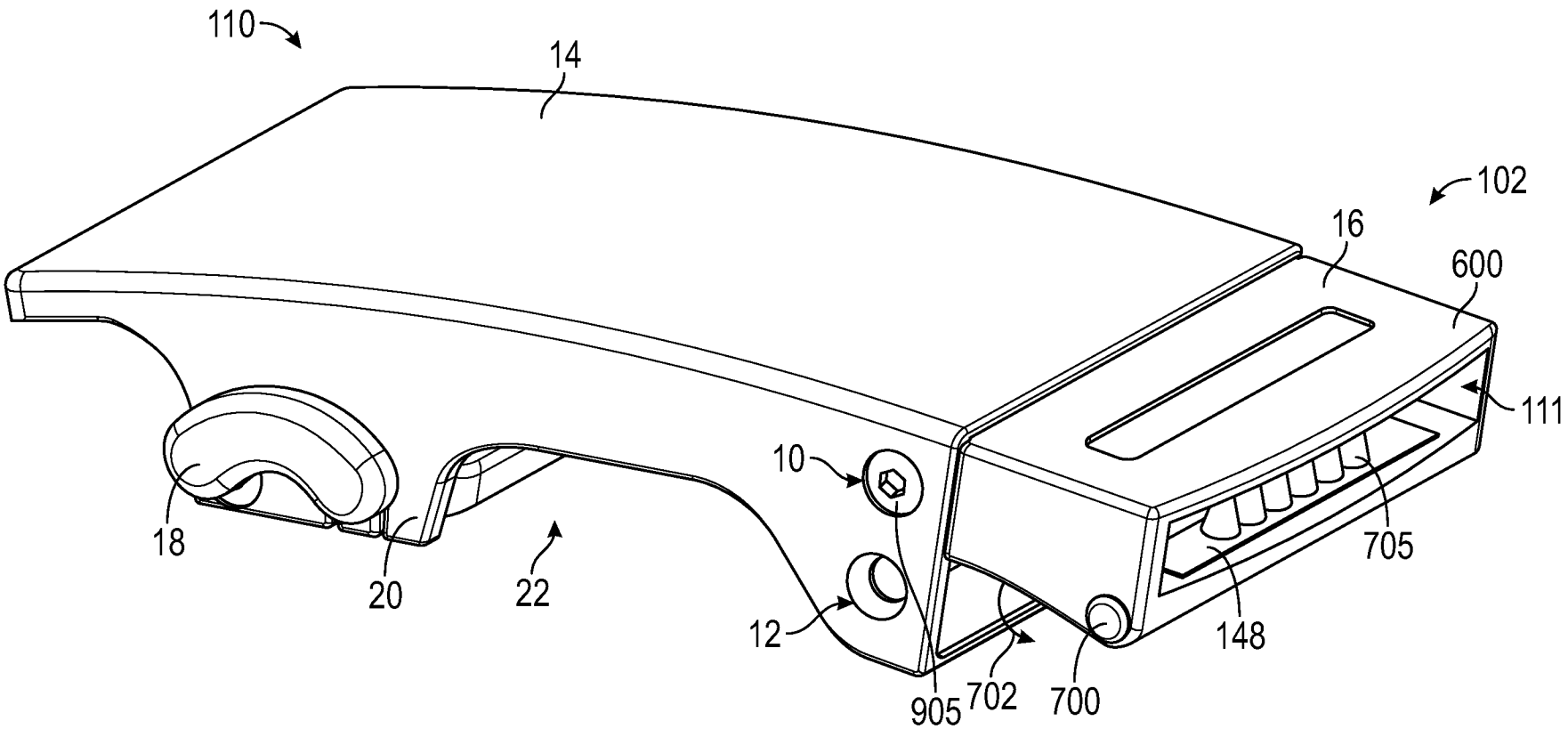
FIG. 3 is a top-side perspective view of a buckle with a clamp coupled to the top location, according to an embodiment of the present disclosure.
Figure 4:
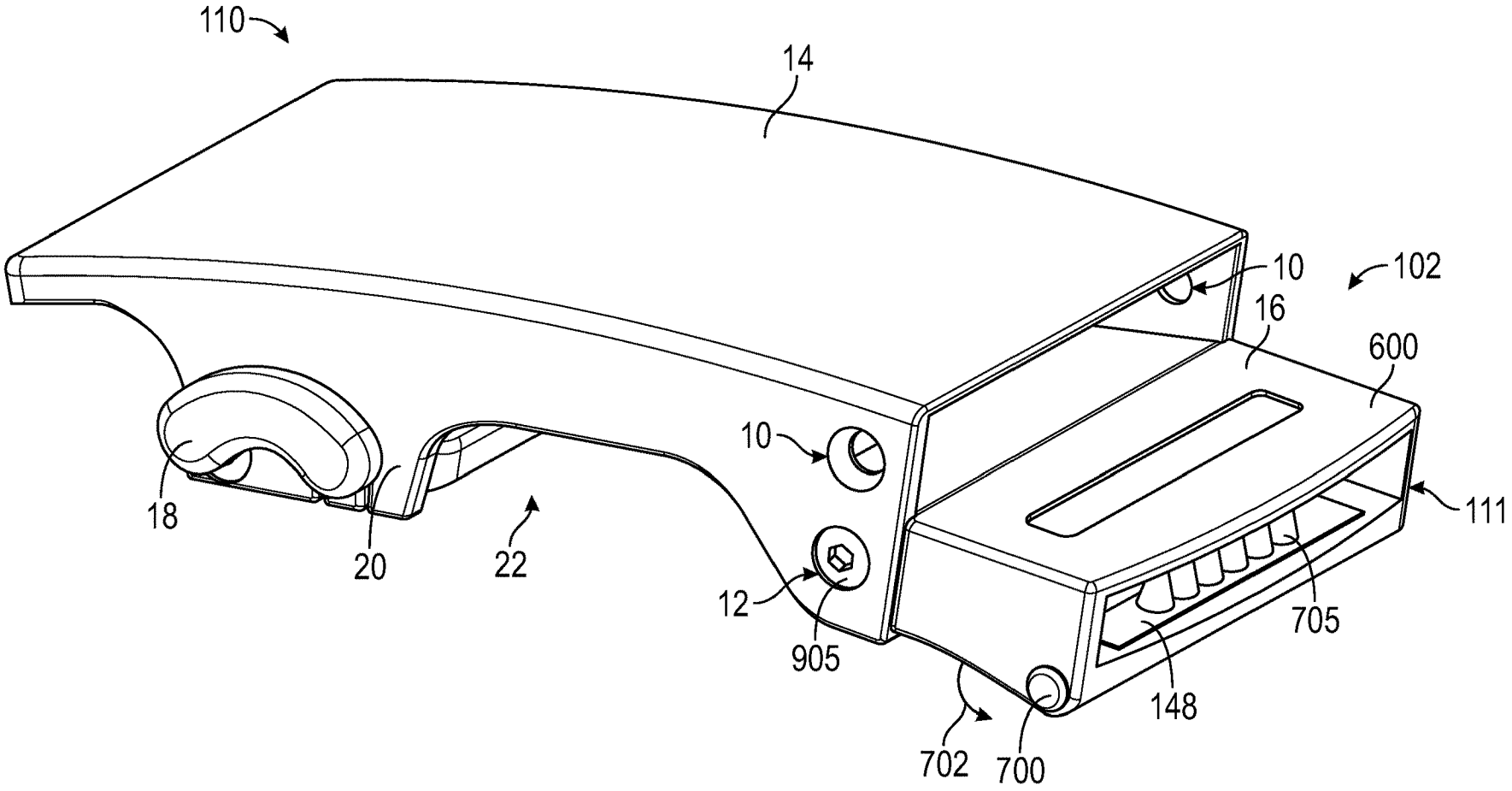
FIG. 4 is a top-side perspective view of a buckle with a clamp coupled to a bottom location, according to an embodiment of the present disclosure

Referring specifically to FIGS. 3 and 4, the buckle 110 includes a clamp 102 that removably secures the belt clamp end 106 to the buckle 110, and a pawl or ratchet mechanism 310 (illustrated for example, in FIG. 5) to secure the belt free end 107 to the buckle 110 when it, as discussed in greater detail below, is inserted into the buckle 110. It should be understood by one of ordinary skill that the ratcheting mechanism 310 replaces a pin that is conventionally used to secure the belt free end 107 to buckle 110.

In use, the belt clamp end 106 attaches to the clamp 102 and the free end 107 is configured to removably engage the buckle 110. According to some embodiments, the belt 105 includes the teeth/engagement members 108 (FIG. 2) that engage the latch, pawl, or ratchet mechanism 310 (FIG. 5) of the buckle 110. It should be appreciated that in some embodiments, the engagement members 108, by being formed as part of the belt 105, substantially increase the stiffness of the belt 105 along the areas where the engagement members 108 are located. The increased stiffness aids when a user attempts to attach an accessory to the belt 105, such as, for example, a holstered firearm or radio. In addition, the increased stiffness aids in looping the belt through the buckle 110 and, as discussed in greater detail below, positioning or otherwise inserting the belt free end 107 between the belt 105 and a wearer's body in order to conceal the belt free end 107.

Referring specifically to FIG. 3, the clamp 102 includes an opening 111 that receives the belt clamp end 106, which is secured within the opening 111 via a clamping force generated by the clamp 102. Clamp 102 is formed of a clamp body 600, which defines the slot-shaped mouth or opening 111 sized to receive the belt clamp end 106. As presently illustrated, clamp 102 is positioned at a top or front location 10 of buckle 110 such that a top surface 16 of the clamp 102 is substantially coplanar with the front face 14 of buckle 110. In such a configuration, clamp 102 does not rest against or contact the user's pants when the belt system 100 is in use. Accordingly, when clamp 102 is positioned at the top location 10, the belt free end 107 is substantially concealed or hidden from view after it is inserted into and through buckle 110. Thus, free end 107 of the belt 105 rests against and contacts the wearer's pants when the belt system 100 is in use. In the embodiment illustrated in FIG. 3, the clamp 102 is secured, coupled to, or otherwise connects to the top location 10 or the bottom location 12 by screws 905 pins, rivets, threaded fasteners, or any other suitable form of fastener.

It should be understood that while clamp 102 is presently depicted at the top location alternate configurations may be used. For example, in the embodiment illustrated in FIG. 4, clamp 102 may be positioned in the bottom location 12, such that belt free end 107 passes over the top surface 16 of clamp 102 and the belt clamp end 106. In such a configuration, clamp 102 rests against the user's pants when the belt system 110 is worn.

The clamp 102 is used to secure the clamp end 106 of belt 105 within opening 111 via a clamping force created by a plurality of upwardly extending teeth 705 positioned on and extending from a clamp door 148. As illustrated for example in FIGS. 3 and 4, the clamp door 148 is pivotably attached to the clamp body 600 about pivot pin 700 such that the door 148 is rotatable between an open position, to allow insertion of the belt clamp end 106 into the body 600, and a closed position, to as discussed below, secure the belt clamp end 106 within the body 600. In particular, a set of retainer members, such as teeth 705, extend from an inner surface of the door 148 so that the teeth 705 can engage and grip a belt 105 when the belt clamp end 106 is inserted through the opening 111 and into the body 600.

Figure 7:
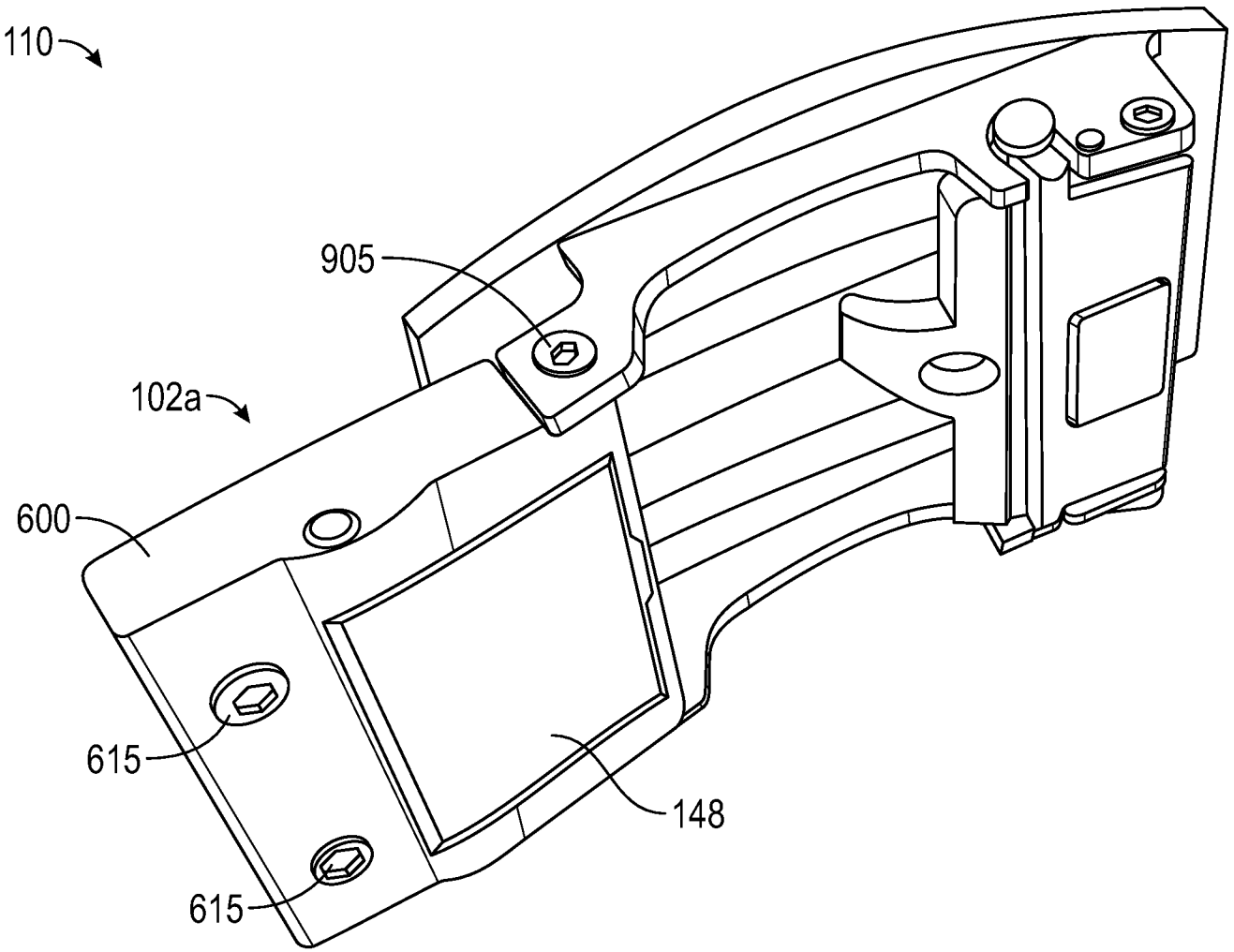
FIG. 7 is a bottom perspective view of a buckle with another embodiment of a clamp, according to an embodiment of the present disclosure.
Figure 8:
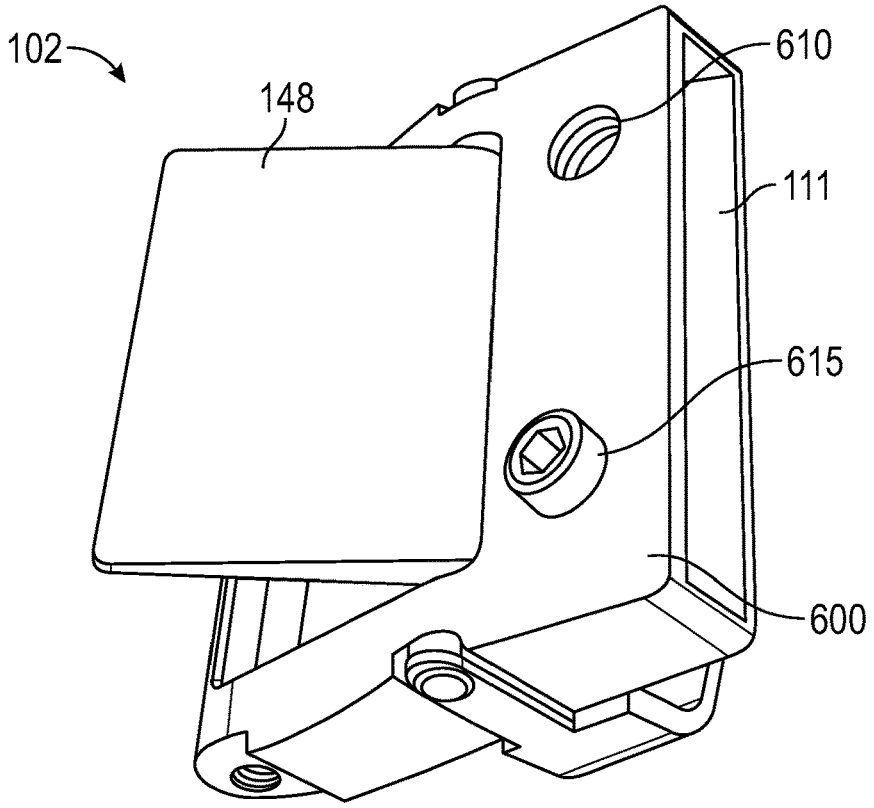
FIG. 8 is a bottom perspective view of an embodiment of a clamp, according to an embodiment of the present disclosure.
Figure 9:
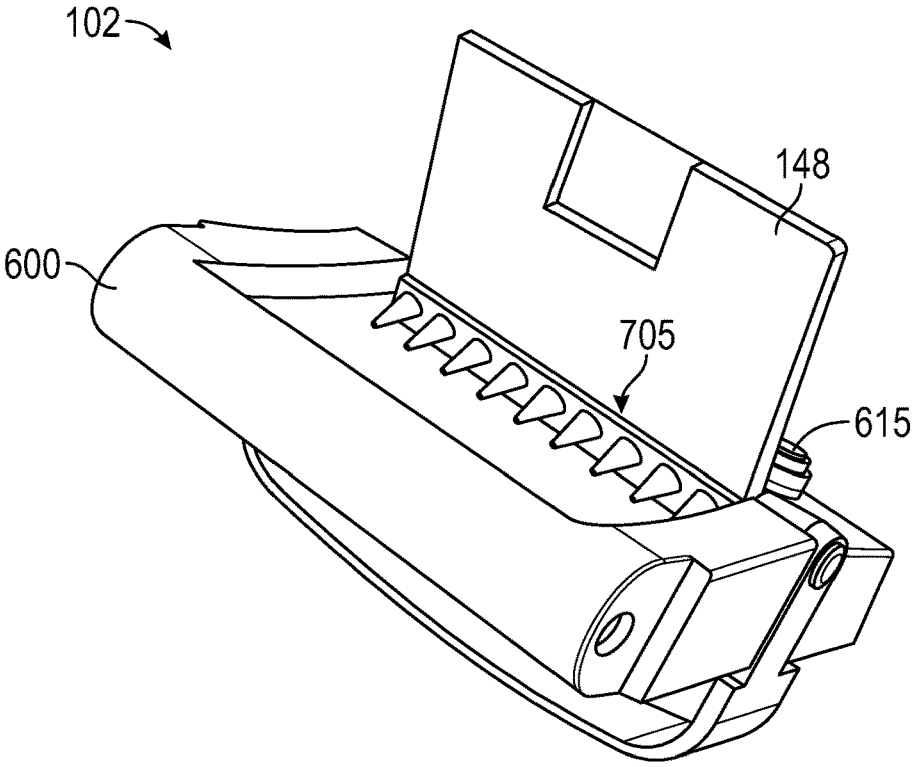
FIG. 9 is a front-side perspective view of an embodiment of a clamp, according to an embodiment of the present disclosure.

In particular, to secure the clamp end 106 within opening 111, first the clamp door 148 is pivoted away from body 600 in the direction of arrow 702 from the closed position (illustrated in FIGS. 3 and 4) to the open position. The clamp end 106 can be is inserted into opening 111. Once inserted, the clamp door 148 is pivoted back to the closed position to teeth 705 against and penetrate, clamp, or otherwise secure clamp end 106 within opening 111. It should be understood, that while clamp 102 secures clamp end 106 within opening 111 with the clamp force created by forcing teeth 705 into the clamp end 106, alternate configurations may be used. For example, and as illustrated in FIGS. 7-9, clamp 102 can also secure clamp end 106 within opening 111 with one or more screws 615 through body 600. In such an embodiment, a screw 615 is inserted into hole 610 such that an end of screw 615 extends into opening 111 in a manner that the end of the screw 615 engages or otherwise contacts the belt 105 when the belt is positioned within the opening 111. The type of screw can vary. In an embodiment, the screw is an Allen screw with a distal end that is pointed or otherwise shaped to increase the likelihood that the distal end of the screw can insert into or otherwise engage the belt. In this manner, screw 615 act as an additional retaining feature (in addition to the teeth 705) that increases the likelihood that the clamp end 106 will be retained within the opening 111 even when external forces are applied to the belt 105 that might otherwise release the belt 105 from clamp 102.

With continued reference to FIGS. 3-4, the body 20 of the buckle 110 is shaped such that a cavity or cut-out 22 is formed along at least a portion of body 20. The cut out 22 is such that a region of body 20 is thinner relative to an adjacent region of body 20. In this manner, the body 20 of the buckle 110 is so that the wearer's pants button does not contribute to or cause the belt buckle 110 to protrude any further outward from the wearer's pants if the wearer's pants did not have a button in the region of the buckle when the buckle is worn. The cut-out portion 22 is dimensioned such that the top button of a user's pants fits within the cut-out portion 22.

The cut-out portion 22 is sized and shaped to form a gap in the body 20 of the buckle 110 in which the wearer's pants button can be positioned when the belt system 100 is in use.

In this manner, the buckle 110 can be positioned atop the button while minimizing the degree that the button contributes to the maximum height that the front face 14 of buckle 110 extends away from the user's waist. The cut-out portion 22 is located along the length of buckle 110. The cut-out portion 22 extends along only a portion of the entire length of buckle 110, such that buckle 110 has a larger thickness in areas that do not include cut-out portion 22 relative to portions of body 20 where the cut-out portion 22 is located.

One or more male fasteners, such as threaded members or threaded screws 905, secure portions of the belt buckle 110 to one another. For example, threaded screws 905 can secure the bridge 350 to the body 20 of the belt buckle 110. In this regard, one or more aligned, threaded openings or passageways can extend through the bridge 350 and the main body 20. While threaded screws 905 are presently depicted, it should be understood that alternate configurations may also be used. For example, screw 905 can be any suitable male fastener such as a rivet or bolt. In addition, the threaded screw 905 can have various types of heads, such as a Phillips head, an Allen head, star head, or any other suitable type of head for attaching to a drive member, such as a screwdriver. It should be appreciated that threaded screws 905 can be used to secure other portions of the buckle to one another.

Figure 5:
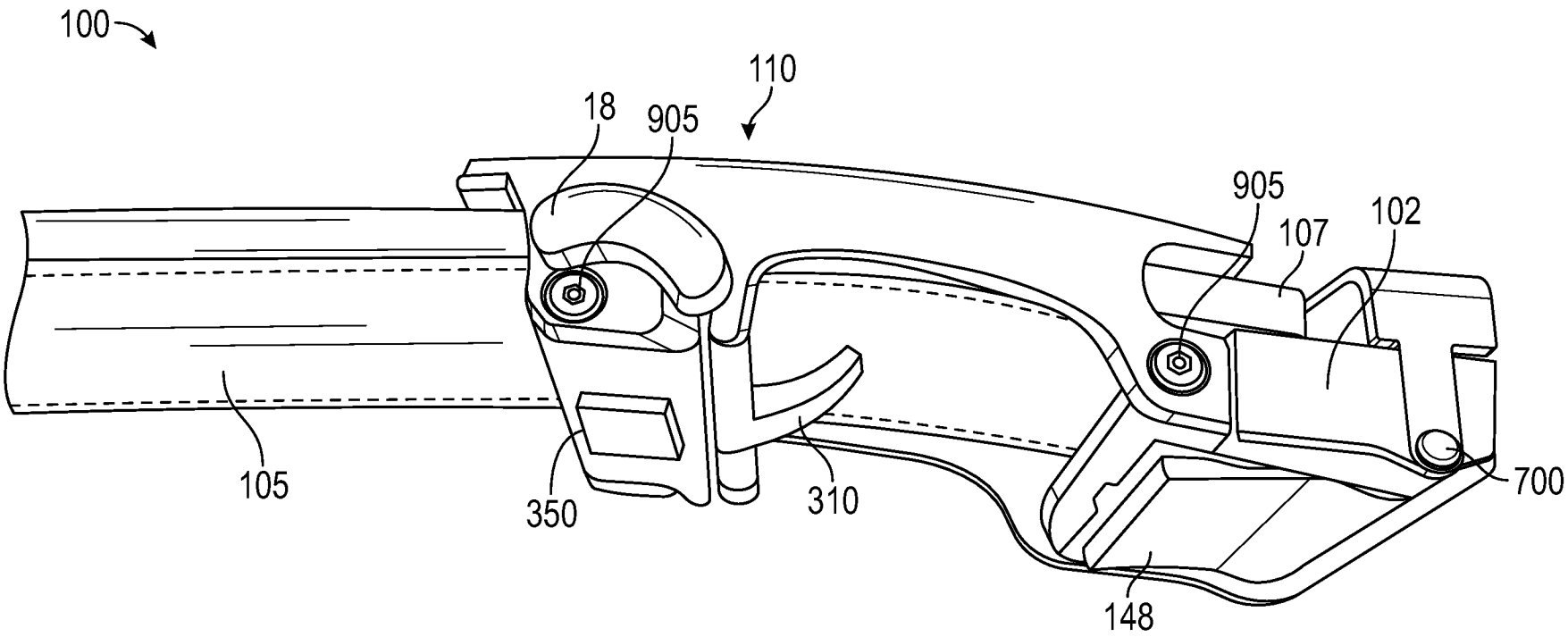
FIG. 5 is a side perspective view of a belt system, according to an embodiment of the present disclosure.
Figure 6:
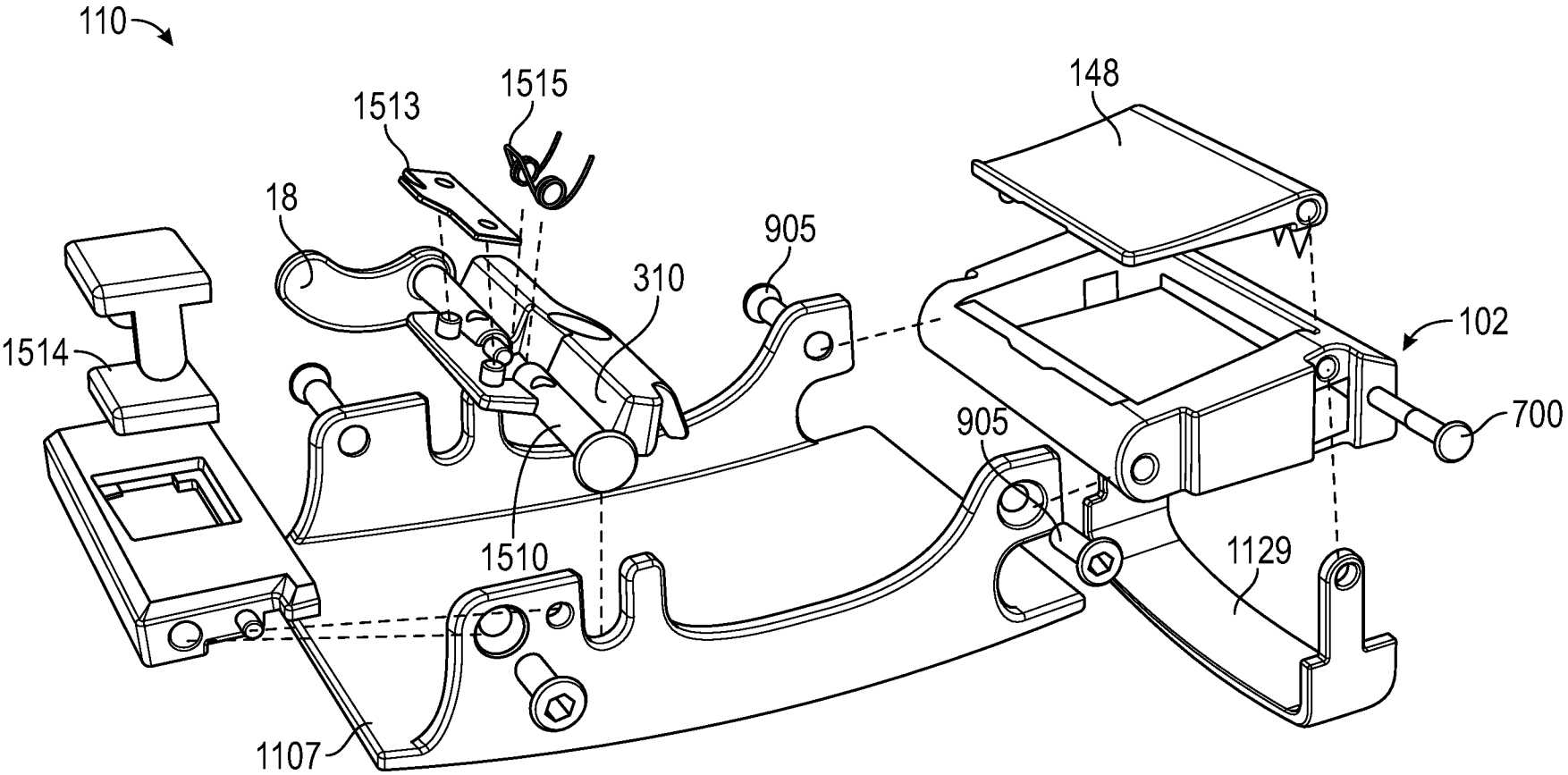
FIG. 6 is an exploded perspective view of a belt system, according to an embodiment of the present disclosure.

Reference is now made to FIGS. 5-6, which illustrates a side perspective view of belt system 100 and an exploded perspective view of a buckle 110. Buckle 110 has a bridge 350 that forms or at least partially defines opening 111 through which the free end 107 of belt 105 can be inserted into when worn by a user. A movable latch 310, or other member configured to engage with teeth 108 is configured to move towards and engage with teeth of the opposite end region of the belt 105 when the opposite region is positioned through the opening formed by the bridge 350 for securing the belt 105 to the buckle 110 in a desired position. In an embodiment, the latch 310 secures to a tooth, teeth, series of teeth 108, or other engagement portion formed within a row of engagement portions on the belt 105 such as located on the free end 107 region of the belt 105 that loops into the buckle 110. The teeth 108 can be located on a side of the belt 105 that faces the movable latch 310 when the belt 105 is looped through the buckle 110. The latch 310 can be biased toward a latching engagement with the tooth or teeth 108 of the belt 105 such as by using a biasing member, which can be, for example, a magnet, a spring, or other device. In other embodiments, buckle 110 includes two or more biasing members such as both a spring and a magnet system, both spring system, or both magnet system. At least a portion of latch 310 can include an actuator, such as a tab 18 by which a user can manually rotate the latch 310 to a disengaged state. To initiate the transition from the engaged state to the free state, the user rotates tab 18 which mechanically rotates latch 310 away from the engaged state and toward the unengaged or free state.

The latch 310 includes a tab 18 that can be actuated by a user to rotate the latch 310 from the engaged state to a disengaged state. In the disengaged or free state, the latch 310 does not engage the latching surface or teeth 108 of the belt 105 such that the belt 105 can slide freely relative to the buckle 110. When in the engaged state, the latch 310 engages the latching surface or teeth 108 of the belt 105 so that the belt 105 is locked in position relative to the buckle 110.

As mentioned, the latch 310 may include a magnet or magnet assembly. As shown in FIG. 6, the magnet assembly can include a magnetic member 1513 coupled to the latch 310 and can further include a corresponding element 1514, such as a metal element, coupled to another portion of the buckle (or vice versa) such as to a portion of the bridge 350. The magnetic member 1513 and the corresponding element 1514 can magnetically attract one another to bias the latch 310 toward the engaged position or engaged state. The latch 310 is also coupled to a spring 1515 that also biases the latch 310 toward the engaged state. In this manner, the magnet assembly and the spring 1515 collectively bias the latch 310 toward the engaged state and/or secure the latch 310 in the engaged states.

In a method of manufacture, one or more of the components of the buckle 110 are provided. The components are assembled in a manner that forms the shape of the buckle 110. One or more of the components can be drilled or tapped with appropriately sized holes, openings, or passageways that are sized and shaped to receive a corresponding screw. One or more of the holes, openings, or passageways can be threaded. An appropriately sized screw can then be inserted into a corresponding opening and threadedly retained in the opening to secure one or more components of the buckle 110 to other components of the buckle 110. The clamp 102 is formed and can be attached to the other components to form the buckle 110.

In many embodiments, belt buckle 110 sits flat against the user's waist or torso such that the buckle 110 will be positioned over the region of the user's pants where a button is typically located on the user's pants.

In some embodiments, buckle 110 includes only a single actuator that is coupled to a single latch member.

In other embodiments, the belt 105 is coupled to a holster that is sized and shaped to hold a firearm, such as a pistol or gun.

Although embodiments of a belt system 100 have been described in detail, those skilled in the art will also recognize that various substitutions and modifications may be made without departing from the scope and spirit of the appended claims.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

In addition, the foregoing describes some embodiments of the disclosure, and alterations, modifications, additions and/or changes can be made thereto without departing from the scope and spirit of the disclosed embodiments, the embodiments being illustrative and not restrictive.

Furthermore, the disclosure is not to be limited to the illustrated implementations, but to the contrary, is intended to cover various modifications and equivalent arrangements included within the spirit and scope of the disclosure. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A belt buckle system, comprising:

a belt having a free end, an opposed clamp end, and a plurality of teeth positioned along the free end of the belt;

a buckle, the buckle including a latch, the latch actuatable between an engaged position and a retracted position, wherein when the latch is in the engaged position, the latch is biased against the teeth to mechanically engage the teeth and secure the free end with the buckle, and when the latch is in the retracted position, the latch is retracted from the teeth to permit removal of the free end from the buckle; and a clamp member to secure the clamp end to the buckle; and wherein the clamp member is configured to be selectably positioned on a top location of the buckle such that the free end of the belt is substantially concealed by the clamp member and the clamp end of the belt when the free end is inserted through the buckle or a bottom location of the buckle such that the free end of the belt passes over a top surface of the clamp member when the free end is inserted through the buckle.

2. The belt buckle system of claim 1, wherein the clamp member and the buckle are separate components.

3. The belt buckle system of claim 1, wherein the belt includes a series of markings on an inner surface of the belt near the clamp end, wherein each marking corresponds to a clothing waist size.

4. The belt buckle system of claim 1, wherein the latch is a pawl.

5. The belt buckle system of claim 1, further comprising a biasing member configured to bias the latch in the engaged position.

6. The belt buckle system of claim 5, wherein the biasing member is a magnet.

7. The belt buckle system of claim 5, wherein the biasing member is a spring.

8. The belt buckle system of claim 5, wherein the biasing member is a first biasing member and further comprising a second biasing member configured to bias the latch.

9. The belt buckle system of claim 8, wherein the first biasing member is a magnet and the second biasing member is a spring.

10. The belt buckle system of claim 1, wherein the latch is configured to be actuated from the engaged position to the retracted position by a release member.

11. A belt buckle system, comprising:

a buckle configured to be positioned on a first end of a belt and to mechanically engage a second end of the belt to secure the belt in a looped configuration when the second end of the belt is inserted into the buckle;

a latch secured to the buckle and biased by a biasing member towards an engaged position to engage a series of teeth disposed on the belt when the second end is inserted into the buckle; and wherein a clamp member is configured to be selectably positioned on a top location of the buckle such that the second end of the belt is concealed by the first end of the belt when the second end is inserted into the buckle or a bottom location of the buckle such that the second end of the belt passes over a top surface of the clamp member when the second end is inserted into the buckle.

12. The belt buckle system of claim 11, wherein the belt includes a series of markings on an inner surface of the belt near the first end, wherein each marking corresponds to a clothing waist size.

13. The belt buckle system of claim 11, wherein the latch is a pawl.

14. The belt buckle system of claim 11, wherein the biasing member is a magnet.

15. The belt buckle system of claim 11, wherein the biasing member is a spring.

16. The belt buckle system of claim 11, wherein the biasing member is a first biasing member and further comprising a second biasing member configured to bias the latch.

17. A belt system, comprising:

a belt having a free end, an opposed clamp end, and a plurality of teeth positioned along the free end of the belt;

a buckle having a latch, a top clamp mounting point, and a bottom clamp mounting point, the latch being actuatable between an engaged position and a retracted position, when the latch is in the engaged position, the latch is biased against the teeth to mechanically engage the teeth and secure the free end with the buckle, and when the latch is in the retracted position, the latch is retracted from the teeth to permit removal of the free end from the buckle;

a clamp member configured to secure the clamp end to the buckle and is configured to be selectably positioned about the top clamp mounting point or the bottom clamp mounting point;

wherein the top clamp mounting point is positioned at a top of the buckle and configured such that the free end of the belt is substantially concealed by the clamp member and the clamp end of the belt when the free end is inserted through the buckle; and wherein the bottom clamp mounting point is positioned at a bottom of the buckle and configured such that the free end of the belt passes over a top surface of the clamp member when the free end is inserted through the buckle.

18. The belt system of claim 17, wherein the top clamp mounting point is positioned above the bottom clamp mounting point.

19. The belt system of claim 17, wherein the top clamp mounting point is defined by a pair of opposed openings.

20. The belt system of claim 17, wherein the bottom clamp mounting point is defined by a pair of opposed openings.

* * * * *